US009120004B2

(12) United States Patent
Saltveit et al.

(10) Patent No.: US 9,120,004 B2
(45) Date of Patent: Sep. 1, 2015

(54) SPORTS STADIUM WITH REMOVABLE TURF FIELD

(75) Inventors: Yngve Saltveit, Sandvika (NO); Claus Johannsen, Jar (NO)

(73) Assignee: Nutcracker Solutions AS, Jar (NO)

( * ) Notice: Subject to any disclaimer, the term of this patent is extended or adjusted under 35 U.S.C. 154(b) by 0 days.

(21) Appl. No.: 14/128,160

(22) PCT Filed: Jul. 2, 2012

(86) PCT No.: PCT/NO2012/050129

§ 371 (c)(1),
(2), (4) Date: Dec. 20, 2013

(87) PCT Pub. No.: WO2013/002649

PCT Pub. Date: Jan. 3, 2013

(65) Prior Publication Data

US 2014/0123566 A1 May 8, 2014

(30) Foreign Application Priority Data

Jun. 30, 2011 (NO) ..... 20110952

(51) Int. Cl.

| | |
|---|---|
| ***E04H 3/26*** | (2006.01) |
| ***A63C 19/02*** | (2006.01) |
| ***A63C 19/12*** | (2006.01) |
| ***E04H 3/14*** | (2006.01) |
| *E01C 13/00* | (2006.01) |

(52) U.S. Cl.

CPC ..... *A63C 19/02* (2013.01); *A63C 19/12* (2013.01); *E04H 3/14* (2013.01); *E01C 2013/006* (2013.01)

(58) Field of Classification Search

CPC ..... E04B 5/43; E04H 3/14; A63C 19/12; A63C 19/02; A63B 69/00

USPC ..... 52/6–10, 43, 741.1, 64, 66; 47/65.9, 47/1.01 R, 1.01 F, 66.6; 473/504; 165/45; 242/390.9

See application file for complete search history.

(56) References Cited

U.S. PATENT DOCUMENTS 1,966,687 A * 7/1934 Scott et al. ..... 473/504
3,099,444 A * 7/1963 Burt ..... 473/504

(Continued)

FOREIGN PATENT DOCUMENTS

DE 2924904 A1 1/1980
DE 3116830 A1 * 11/1982 ..... E04H 3/19

(Continued)

OTHER PUBLICATIONS

NPL, Colosseum, built in 70-80 AD.*

(Continued)

*Primary Examiner* — Beth Stephan
(74) *Attorney, Agent, or Firm* — Winstead PC

(57) ABSTRACT

Sports stadium (1) with a turf field (100) and a surrounding spectators stand (3). The turf field (100) comprises a plurality of turf modules (101) supported on a fixed support base (105). The turf modules are movable on the fixed support base, thereby being removable from the fixed support base. The fixed support base (105) exhibits an aperture (111) constituting access to a storage room (107) below the fixed support base (105). The storage room is adapted for storage of the turf modules. A lift (115) is arranged to move turf modules through the aperture (111). An associated method is also described.

13 Claims, 14 Drawing Sheets

(56) References Cited

U.S. PATENT DOCUMENTS

| | | | | | |
|---|---|---|---|---|---|
| 4,352,260 | A | * | 10/1982 | Pearcey et al. | 52/81.2 |
| 4,399,954 | A | * | 8/1983 | Arrant | 242/393 |
| 4,588,189 | A | * | 5/1986 | Arrant | 473/416 |
| 4,640,469 | A | * | 2/1987 | Mackintosh | 242/388 |
| 4,735,024 | A | * | 4/1988 | Rosato et al. | 52/126.6 |
| 4,738,407 | A | * | 4/1988 | Arrant | 242/390.2 |
| 5,187,894 | A | * | 2/1993 | Ripley et al. | 47/86 |
| 5,319,895 | A | * | 6/1994 | Ray | 52/6 |
| 5,365,704 | A | * | 11/1994 | Ray | 52/64 |
| RE35,006 | E | * | 8/1995 | Ripley et al. | 47/65.9 |
| 5,468,190 | A | * | 11/1995 | McCaffrey | 472/82 |
| 5,595,021 | A | * | 1/1997 | Ripley et al. | 47/66.5 |
| 5,746,028 | A | * | 5/1998 | DiBenedetto | 52/6 |
| 5,927,022 | A | * | 7/1999 | Hirakawa et al. | 52/6 |
| 5,944,444 | A | * | 8/1999 | Motz et al. | 405/37 |
| 5,974,743 | A | * | 11/1999 | Vaia | 52/169.6 |
| 6,070,824 | A | * | 6/2000 | Du Pont | 242/393 |
| 6,134,834 | A | * | 10/2000 | Ripley et al. | 47/86 |
| 6,202,356 | B1 | * | 3/2001 | Hock | 52/6 |
| 6,263,616 | B1 | * | 7/2001 | Hummer | 47/65.9 |
| 6,286,264 | B1 | * | 9/2001 | Peuler | 52/6 |
| 6,398,455 | B1 | * | 6/2002 | Vølstad | 405/43 |
| 6,698,141 | B2 | * | 3/2004 | Silberman et al. | 52/6 |
| 7,090,586 | B1 | * | 8/2006 | Everett et al. | 472/92 |
| 7,958,669 | B2 | * | 6/2011 | Casimaty et al. | 47/1.01 F |
| 2004/0006926 | A1 | * | 1/2004 | Neeley et al. | 52/6 |
| 2007/0237583 | A1 | * | 10/2007 | Corwon et al. | 405/37 |
| 2008/0060262 | A1 | * | 3/2008 | Lysa | 47/20.1 |
| 2008/0098652 | A1 | * | 5/2008 | Weinbel | 47/1.1 F |
| 2010/0072315 | A1 | * | 3/2010 | Gordon et al. | 242/390.9 |
| 2010/0104778 | A1 | * | 4/2010 | Wise | 428/17 |
| 2011/0045916 | A1 | * | 2/2011 | Casimaty et al. | 472/92 |
| 2012/0168550 | A1 | * | 7/2012 | Gordon et al. | 242/390.9 |
| 2012/0272585 | A1 | * | 11/2012 | Bilsen et al. | 52/7 |
| 2013/0284397 | A1 | * | 10/2013 | Storm | 165/45 |

FOREIGN PATENT DOCUMENTS

| | | | | | |
|---|---|---|---|---|---|
| EP | 1500416 | A1 | | 1/2005 | |
| GB | 2138690 | A | | 10/1984 | |
| GB | 2317348 | A | * | 3/1998 | A63C 19/12 |
| JP | H074705 | U | | 1/1995 | |
| JP | 09271557 | A | * | 10/1997 | A63C 19/02 |
| JP | 09308725 | A | * | 12/1997 | A63C 19/02 |
| JP | 11070207 | A | | 3/1999 | |
| JP | 2000356046 | A | | 12/2000 | |
| JP | 2002088959 | A | | 3/2002 | |

OTHER PUBLICATIONS

Skalland, Øystein, prepared for PCT/NO2012/050129, as mailed Sep. 28, 2012, 3 pages.

Everett, Rob, "Moveable Turf Systems" Turf Issues, Turfgrass Bulletin, Issue 214, Oct. 2001, pp. 12-16.

* cited by examiner

SPORTS STADIUM WITH REMOVABLE TURF FIELD

The present invention relates to a sports stadium having a turf field, such as a field of artificial or natural grass. In particular the invention relates to such a stadium where the turf can be removed and/or re-assembled in a quick fashion without disturbing adjacent elements of the stadium, such as the spectators stands. The invention also relates to associated methods using the sports stadium.

BACKGROUND

Modern sports stadiums are costly to build and maintain. Hence it is in the owner's interest to use it as much as possible in order to meet the costs. For instance, the home ground of a football team is used for sports typically once every second week during the season, and even less outside the season. In addition there will typically be some other matches such as cup matches. As a result, the stadium will be left unused in most of its time. In the last decades, one has started to use such stadiums also for cultural events such as large concerts. Such events constitute an important income for the stadium owners.

However, a large concert held on a natural turf field will or may destroy the grass. Means of protecting the turf are often used, but are not always sufficient. Moreover such protecting means takes time to install and remove. As a result, the stadium owner cannot quickly change the modus of the stadium between a sports event and a cultural event. He is bound by his obligation to provide a quality turf for the sports event, making it difficult to provide possible dates for other cultural events.

This problem has existed for decades and several known solutions have been suggested to overcome it. Some solutions regard protecting or covering the field, while others involve removing the field instead of protecting it in situ.

German publication DE2924904 from 1980 describes a floor consisting of floor modules which are adapted to cover an ice field. The modules are plates that are removed from the ice and stored below a ceiling. Thus the modules protect the ice when the ice field is not in use.

Another system adapted for protection of an existing field is described in European patent application publication EP1500416. It describes a sheet cover rolled onto a roller that is arranged in a trench. To protect the turf field, the cover is rolled out and laid onto the field.

*Turfgrass Bulletin* presents an article in its October issue of 2001 (Issue No. 214) describing a pitch made up of movable turf modules. The modules are approximately 1-2 $m^2$ each and are moved out of the stadium by an ordinary forklift. Below the turf modules there is a fixed support base, such as a concrete floor.

Such a system is also described in publication GB2138690. The publication describes how the individual modules can be moved or replaced to facilitate uneven wear or the turves to be equated from within the arena or replacement from spare units.

The solutions involving covering the turf field exhibit a problem in that the grass will deteriorate if covered for long periods. Furthermore, even if covered with plates or a sheet cover, events such as a concert, with all the associated equipment such as a stage and trucks and camera/sound gear and audience, will physically damage the turf.

The solutions involving removing the turf exhibit a disadvantage in that removing the vast number of turf modules is cumbersome and time consuming. Moreover, storage space for the turf modules is needed either outside the stadium or within the stadium construction. The latter represents valuable space such as for office premises, shops, VIP-rooms, etc. Hence this is not a desired solution.

The object of the present invention is to provide a solution that remedies the disadvantages of the solutions according to the prior art. A particular object of the invention is to provide a solution that makes possible a quick removal of the turf field and also a quick re-assembly of the turf field.

THE INVENTION

According to a first aspect of the present invention there is provided a sports stadium with a turf field and a surrounding spectators stand. The turf field comprises a plurality of turf modules supported on a fixed support base. The turf modules are movable on the fixed support base, thereby being removable from the fixed support base. According to the invention, the fixed support base exhibits an aperture constituting access to a storage room below the fixed support base. The storage room is adapted for storage of the turf modules. Moreover, a lift is arranged to move turf modules through the aperture.

As used herein, a sports stadium is a location where sports, such as fotball (soccer) or American football, is performed on a regular basis. Such sports stadiums according to the invention are stadiums that are surrounded partly or fully by spectators stands. Preferably at least three out of four sides of a substantially rectangular turf field is provided with a spectators stand. Even more preferably all four sides of such a turf field are provided with spectators stands. Also intersections between stands extending parallel to a rectangular side of such a turf field may advantageously be provided with spectators stands. The turf field may also be of a non-rectangular shape.

The turf field may comprise natural grass or artificial grass.

According to the invention, the aperture is arranged in the fixed support base. Advantageously the aperture is arranged in an area of the turf field, thereby constituting a part of the sports field or pitch when the turf field is in use. In such a preferred embodiment the aperture will be closed during use of the turf field and also covered by one or more turf modules.

The fixed support base is plane and can for instance comprise concrete and/or asphalt.

Preferably the sports stadium according to the invention comprises an aperture support base adapted to be removably fixed in the aperture. One can, however, also imagine an embodiment without such an aperture support base. In such an embodiment the lift can be positioned to maintain a turf module in the position of the aperture.

The lift can comprise a lifting section that has two or more module shelves, in stead of one, which each is adapted to accommodate a turf module or more turf modules. In one embodiment, the module shelves can be arranged horizontally adjacent each other in substantially the same plane/level. In another embodiment, the shelves can be arranged on top of each other, resulting in a smaller required aperture. One can also imagine more than one lift adapted to lift the turf modules through the aperture. For instance, one may arrange two or three or even more lifts in association with the aperture.

The turf modules can advantageously exhibit an interlocking mechanism that releasably locks adjacent turf modules together. Such a mechanism will ensure that the modules remain in their correct mutual position so that no clearances will appear between the turf modules. In one embodiment the interlocking mechanism can exhibit sliding engaging inclined surfaces that will keep the turf modules in abutment with each other.

Preferably, the largest turf module exhibits a turf area of more than 30 $m^2$. Preferably, the area is more than 100 $m^2$. Furthermore, the entire turf field can advantageously comprise less than 100 turf modules. A small number of turf modules will reduce the required time needed to assemble or disassemble the turf field. In addition the amount of interfaces between the turf modules will be reduced, facilitating a more uniform turf field.

Preferably, the lift is arranged below the aperture so that horizontal movement of the lift is not required. Moreover, a plurality of module storage shelves in the storage room can be arranged in a vertical row adjacent a vertical lifting path of the lift. Thereby only a horizontal movement of the turf modules between the module storage shelves and the lift is needed for transportation of the turf modules into or out of the module storage shelves in the storage room.

The aperture can advantageously be arranged at a distance from the surrounding spectators stand of at least the distance constituted by one turf module. That is, in this embodiment at least one row of turf modules will be arranged between an aperture row and the end line of the turf field. The aperture row is the row of turf modules that will extend over the aperture. When installing the turf modules to assemble the turf field, the row of turf modules that is finally lifted out from the storage room will be this aperture row. To be able to lift these final turf modules up and through the aperture, the adjacent turf modules must be arranged at some distance from the aperture in order to avoid collision with the turf modules already installed. Hence, when the finally elevated row (the aperture row) has been elevated, it will be moved into abutment with the adjacent row. Thereafter a row being between the aperture row and the said end line will be moved after and into abutment with the aperture row to complete the turf field. As a result of this, the fixed support base needs to extend beyond the turf field in this area, so as to make possible the final movement of the end row into abutment with the rest of the rows.

For making the turf modules movable on a flat surface, such as the fixed support base, they can comprise a set of wheels that are adapted to be moved up and down with respect to the turf module. In another embodiment, they comprise a set of air cushions activated by supplying pressurized air.

The storage room can in one embodiment comprise artificial lighting adapted for grass growth. The storage room can preferably also comprise a watering arrangement adapted to provide the grass with water. Hence, with the combination of light and water, the user will be able to maintain the turf in the storage room under controllable conditions. For instance during cold weather, such as in the winter time, the user can store the turf in a heated environment in the storage room. By controlling temperature, water supply and nutrition to the turf, he can adjust the grow rate of a natural grass turf within a large range.

According to a second aspect of the present invention there is provided a method of removing a turf field of a sports stadium. The turf field is surrounded by spectator stands. Moreover the turf field comprises a plurality of turf modules which have been assembled together to constitute the turf field. According to the second aspect of the invention, the method comprises the following steps a) moving the turf modules with a lift, through an aperture in a fixed support base and into a storage room below said fixed support base;

b) arranging an aperture support base in the aperture.

The aperture support base may in one embodiment be a rigid plane element which can be locked in place in the aperture, in plane with the fixed support base that surrounds the aperture. One may also arrange the lift in such an elevation that its lifting section constitutes the aperture support base and fills the aperture and is in plane with the adjacent fixed support base surrounding the aperture. In such an embodiment a dedicated aperture support base is not needed.

According to a third aspect of the present invention there is provided a method of protecting a turf field of a sports stadium from a cold temperature during winter.

The method comprises the following steps:

a) moving a plurality of turf modules through an aperture in a fixed support base and into a storage room below said fixed support base;

b) maintaining a storage room temperature in the storage room that is warmer than the said cold temperature;

c) lighting and watering the turf modules.

It will be appreciated by a person skilled in the art that the various features and embodiments described in reference to the first aspect of the invention may also apply to the second and third aspect of the invention.

In some embodiments of the various aspects of the invention, in stead of one lift, one may employ a plurality of lifts, for instance two or three. The lifts may be arranged next to each other, preferably below the aperture. In this manner more lifts can operate simultaneously and the transport of turf modules through the aperture can be performed faster. Such a redundancy of lifts will further reduce the negative effect of a malfunctioning lift.

DETAILED EXAMPLE OF EMBODIMENT

While the invention has been described in general terms above, a more detailed example of embodiment will be given in the following with reference to the drawings, in which FIG. 1 is a principle perspective view of a sports stadium according to the invention, comprising a turf field comprising a plurality of turf modules;

Figure 1:
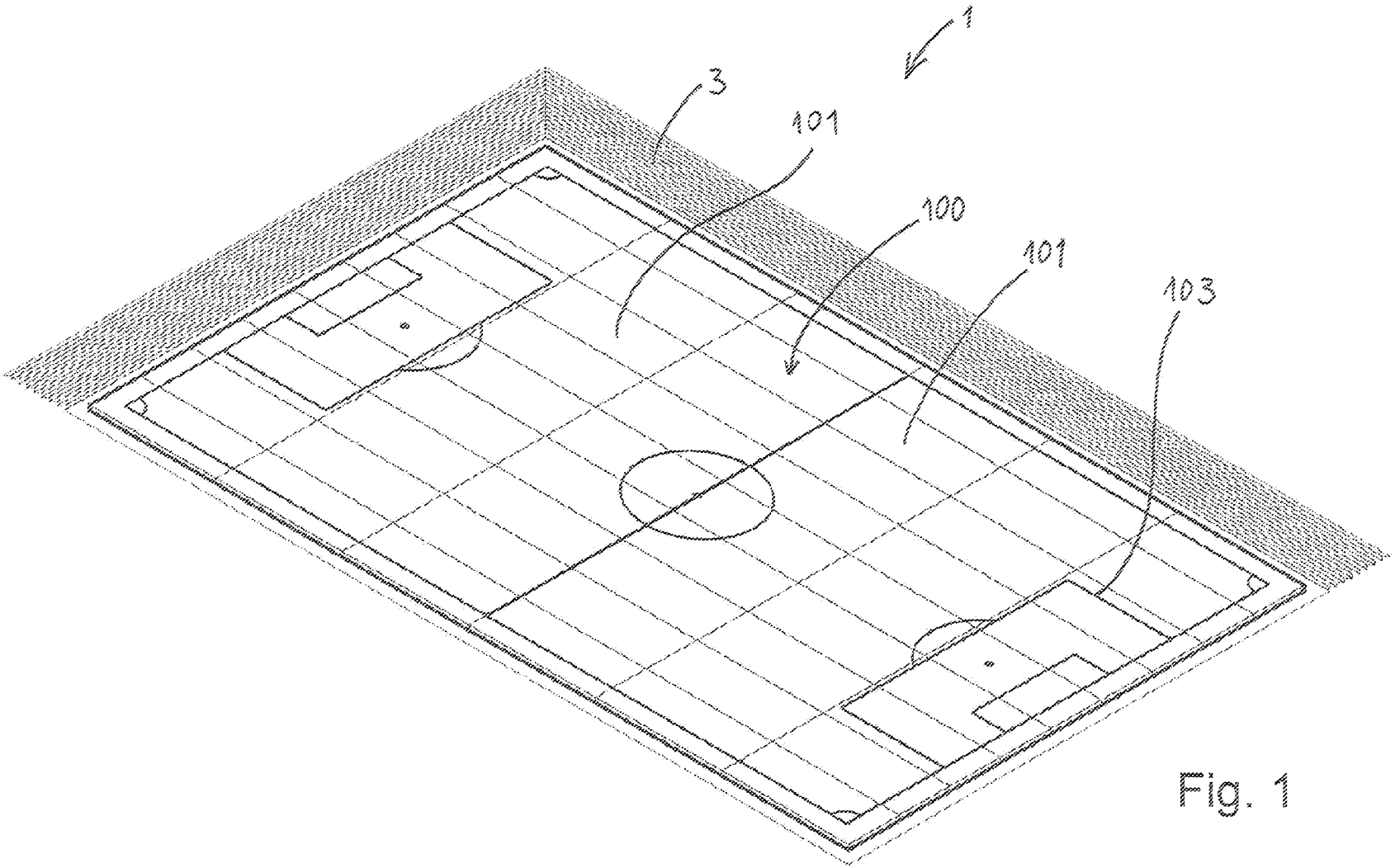

FIG. 1 shows an embodiment of a sports stadium 1 according to the present invention. The sports stadium 1 has a turf field 100 and a surrounding spectators stand 3. The turf field 100 is made up of a plurality of turf modules 101. In this embodiment the turf field 100 has 54 turf modules 101 (6×9). Some of the turf modules 101 have field lines 103 which together with the field lines 103 of adjacent turf modules 101 constitute the field lines of an entire fotball field.

Figure 2:
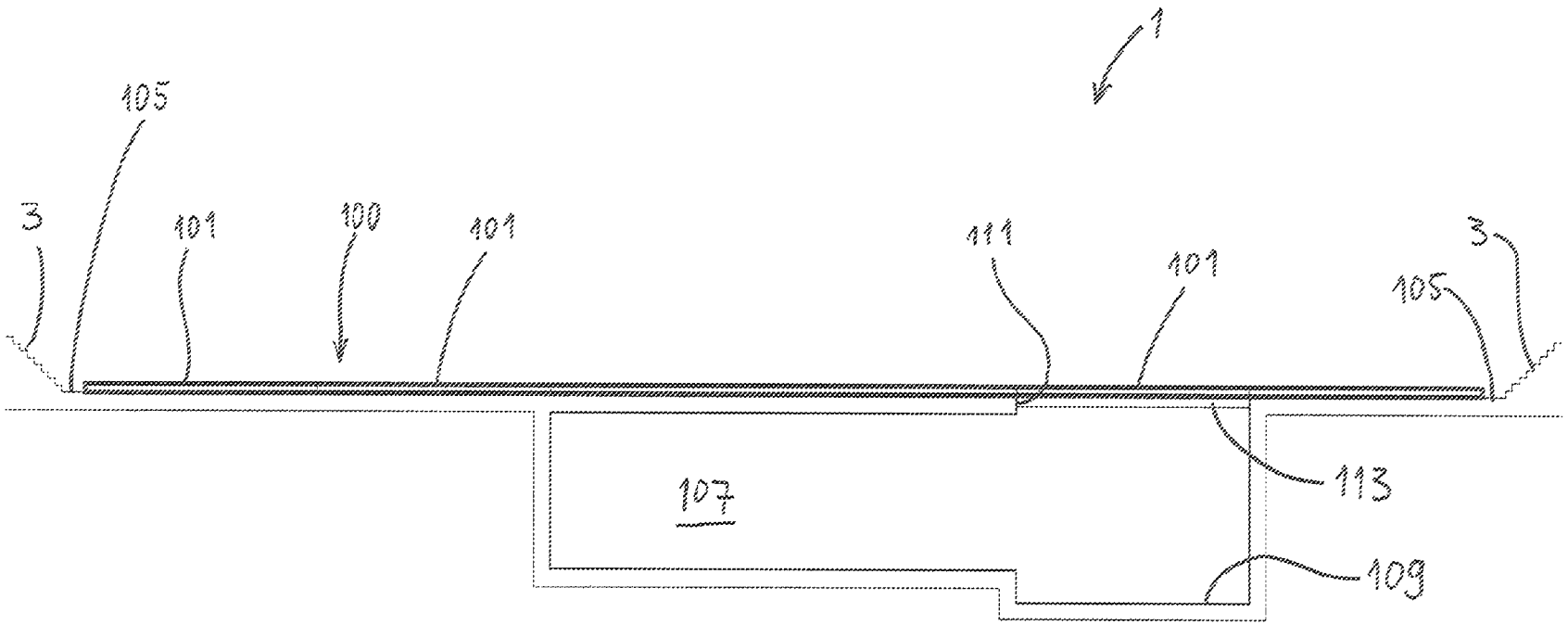
FIG. 2 is a vertical cross section view of the sports stadium shown in FIG. 1.

FIG. 2 shows the sports stadium 1 in FIG. 1 with a cross section side view. The turf modules 101 are supported on a fixed support base 105 which has an area which is somewhat larger than the area of the turf field 100. Below the fixed support base 105 there is arranged a storage room 107. The storage room 107 is adapted to store turf modules 101. This will be described further below.

In the storage room 107 there is a lift supporting base 109, which is arranged to support a lift. Above the lift supporting base 109 in the storage room 107 there is an aperture 111 in the fixed support base 105. The aperture 111 is of such size that a turf module 101 can be moved through it while in a horizontal position, i.e. without changing its orientation. In some embodiments the aperture 111 may be large enough to move for instance two or three or even more adjacently arranged turf modules 101 through it.

In FIG. 2 is also shown a removable aperture support base 113 arranged in the aperture 111. The aperture support base 113 can be releasably fixed to the fixed support base 105 and in the aperture 111, in order to close the aperture 111. Thus, with the aperture support base 113 fixed in the aperture 111, it is able to support one or more turf modules 101 resting on it. In stead of an aperture support base that fully closes the aperture 111, one may also imagine an aperture support base in the form of a framework or a beam construction that will not fully close the support base but which still can support turf module(s) 101 on top of it. One may also imagine an element which is a combined aperture support base and turf module, i.e. a turf module which can be locked in the aperture 111 and which carries a turf on top of it, thereby constituting a part of the turf field 100.

Figure 3:
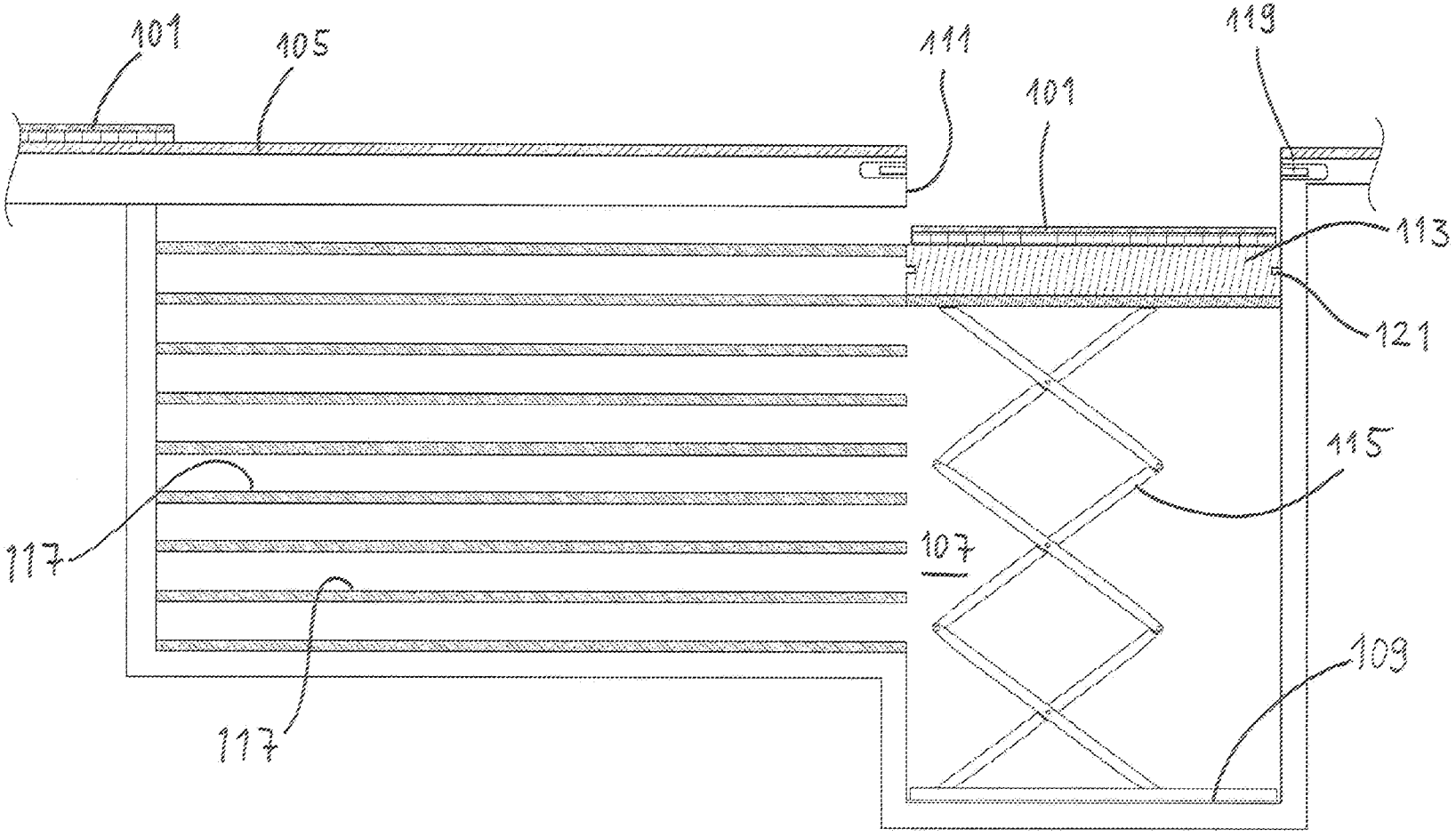
FIG. 3 is a vertical cross section view of a storage room, a lift, and a part of the turf field.

FIG. 3 shows an enlarged cross section side view of a part of the fixed support base 105 and the storage room 107 below it. On the lift supporting base 109 in the storage room 107 there is arranged a lift 115. In this embodiment the lift 115 is of the scissor lift type. The lift 115 can for instance be hydraulically or electrically operated. The lift 115 is adapted to lift a turf module 101 upwards of downwards. In addition it is adapted to lift the aperture support base 113, as shown in FIG. 3.

Next to the lift 115 the storage room 107 comprises a plurality of module storage shelves 117. As will be described further below, the turf modules 101 are movable on a flat surface. Hence, by means of the lift 115 the modules 101 can be positioned next to a module storage shelf 117 and then be moved from the lift 115 onto the shelf 117. A turf module 101 may also be moved from the module storage shelf 117 onto the lift 115, in order to move it from the storage room 107, through the aperture 111 and onto the fixed support base 105.

In FIG. 3 can also be seen an aperture lock 119 arranged at the edge of the aperture 111. The aperture lock 119 comprises a plurality of bolts adapted to engage with receiving aperture lock profiles 121 in the aperture support base 113.

Figure 4:
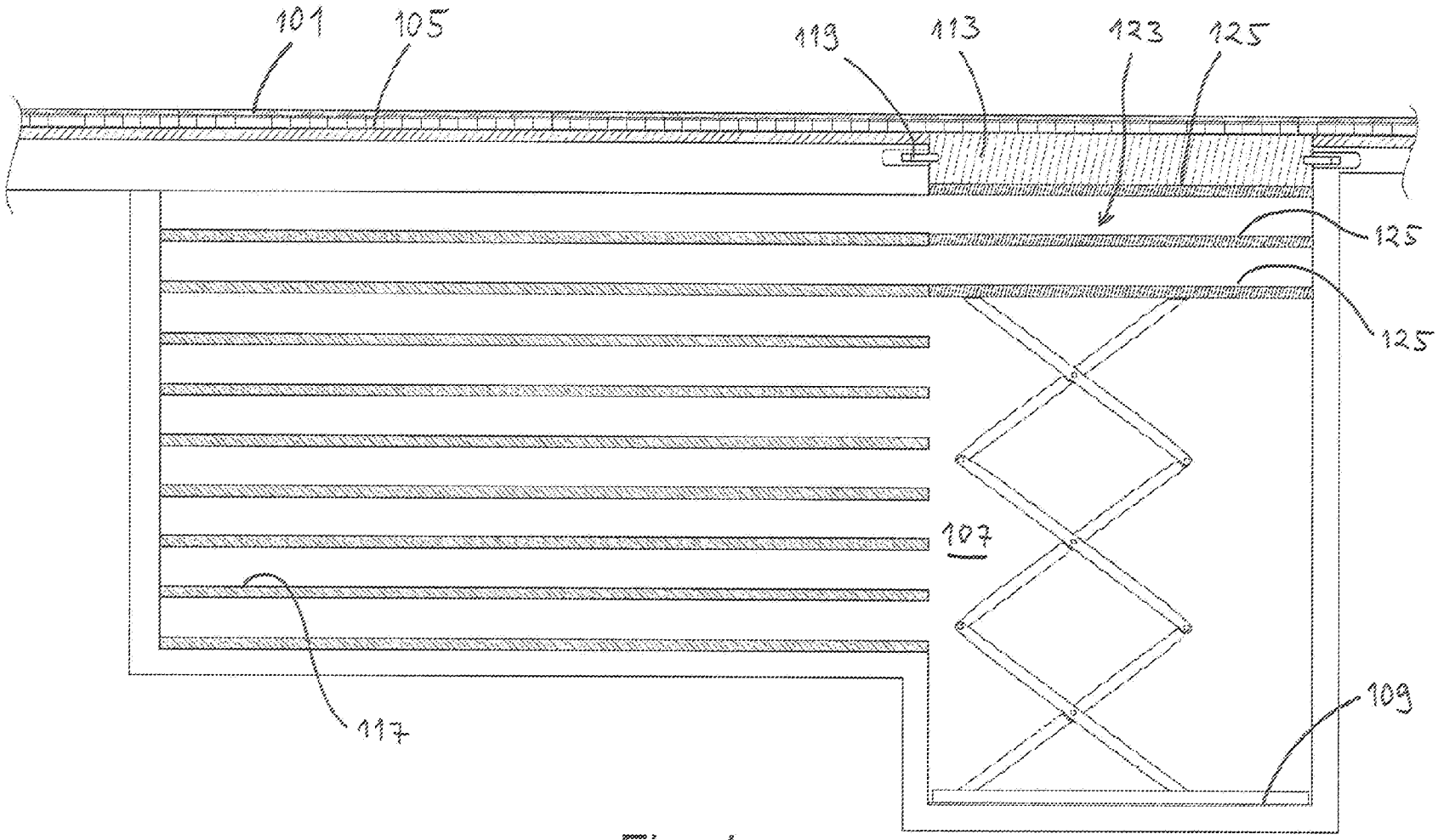
FIG. 4 is a vertical cross section view of a storage room, a lift having three module shelves, and a part of the turf field.

FIG. 4 shows a situation wherein the aperture support base 113 is locked to and is in plane with the fixed support base 105. In this position, the bolts of the aperture lock 119 extend onto the aperture lock profiles 121 of the aperture support base 113. In this position, the lift 115 can move down to a lower elevation, leaving the aperture support base 113 in position in the aperture 111.

FIG. 4 shows a particular embodiment of the lift 115. In this embodiment, the lift 115 has a lifting section 123 with three module shelves 125 which each is adapted to accommodate a turf module 101. Having more than one module shelf 125 on the lifting section 123 will save time during assembly or disassembly of the turf field 100.

Figure 5:
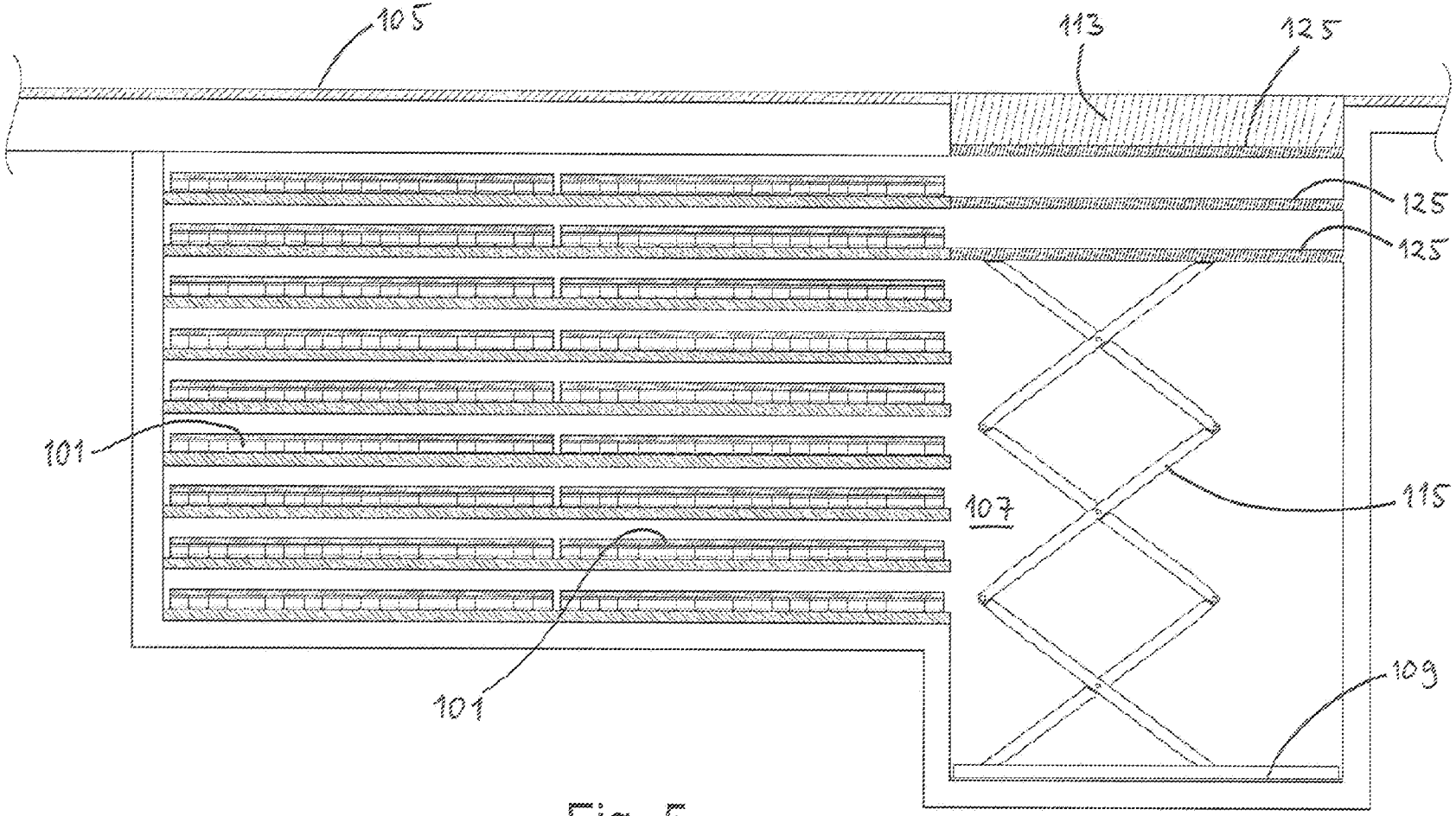
FIG. 5 is a cross section view according to FIG. 4, however with the turf modules stored in the storage room.

FIG. 4 and FIG. 5 show the lift 115 in the same elevated position. However, in FIG. 4 the turf modules 101 are arranged on the fixed support base 105 and the aperture support base 113, while in FIG. 5 the turf modules 101 are shown arranged on the module storage shelves 117 in the storage room 107 below the fixed support base 105. In the situation shown in FIG. 5, the fixed support base 105 together with the aperture support base 113 constitute a flat foundation suitable for many different events, such as a concert.

Figure 6:
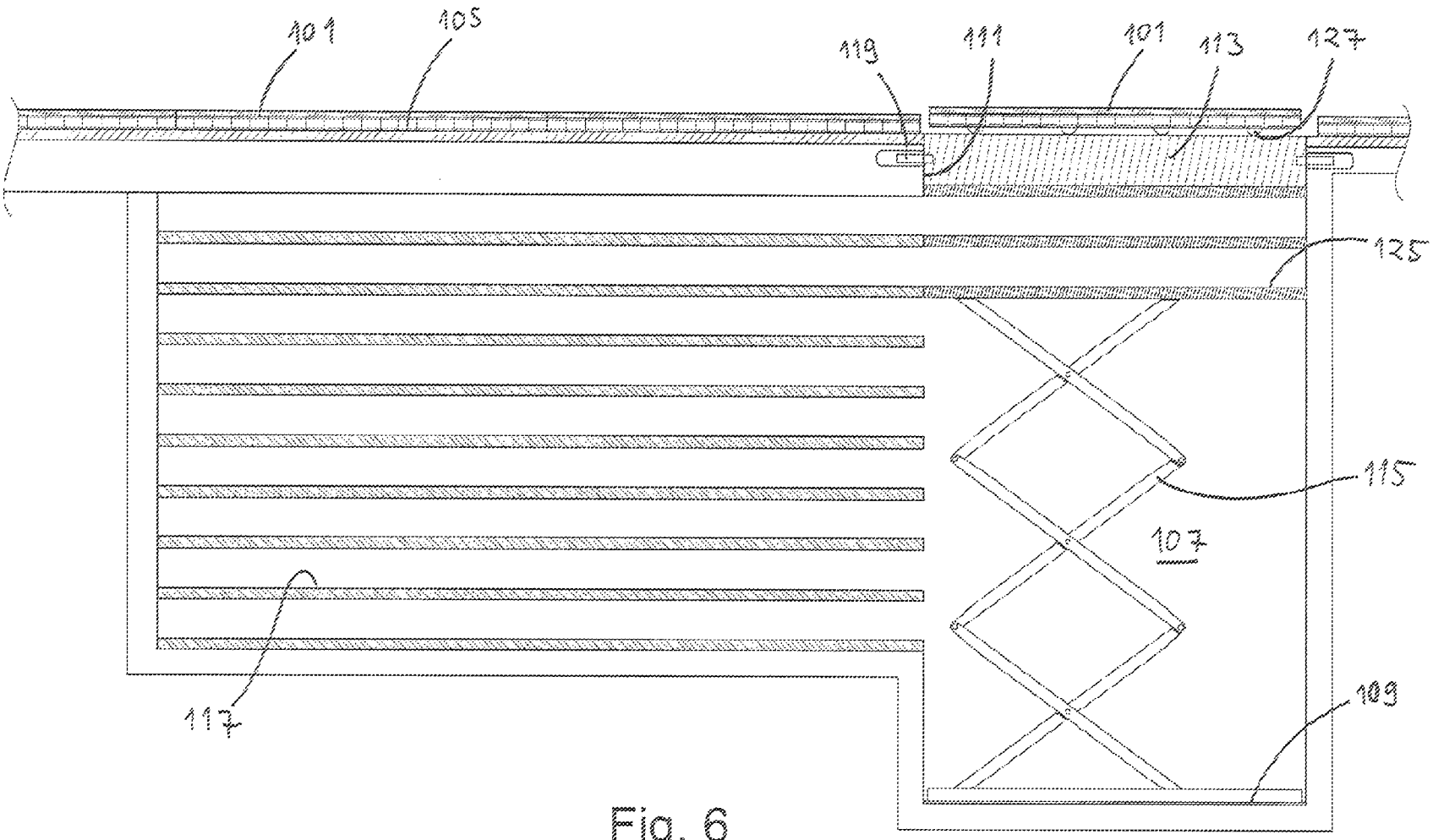
FIG. 6 is a cross section view according to FIG. 4, showing the lift in a high position and a turf module in a transport mode.
Figure 7:
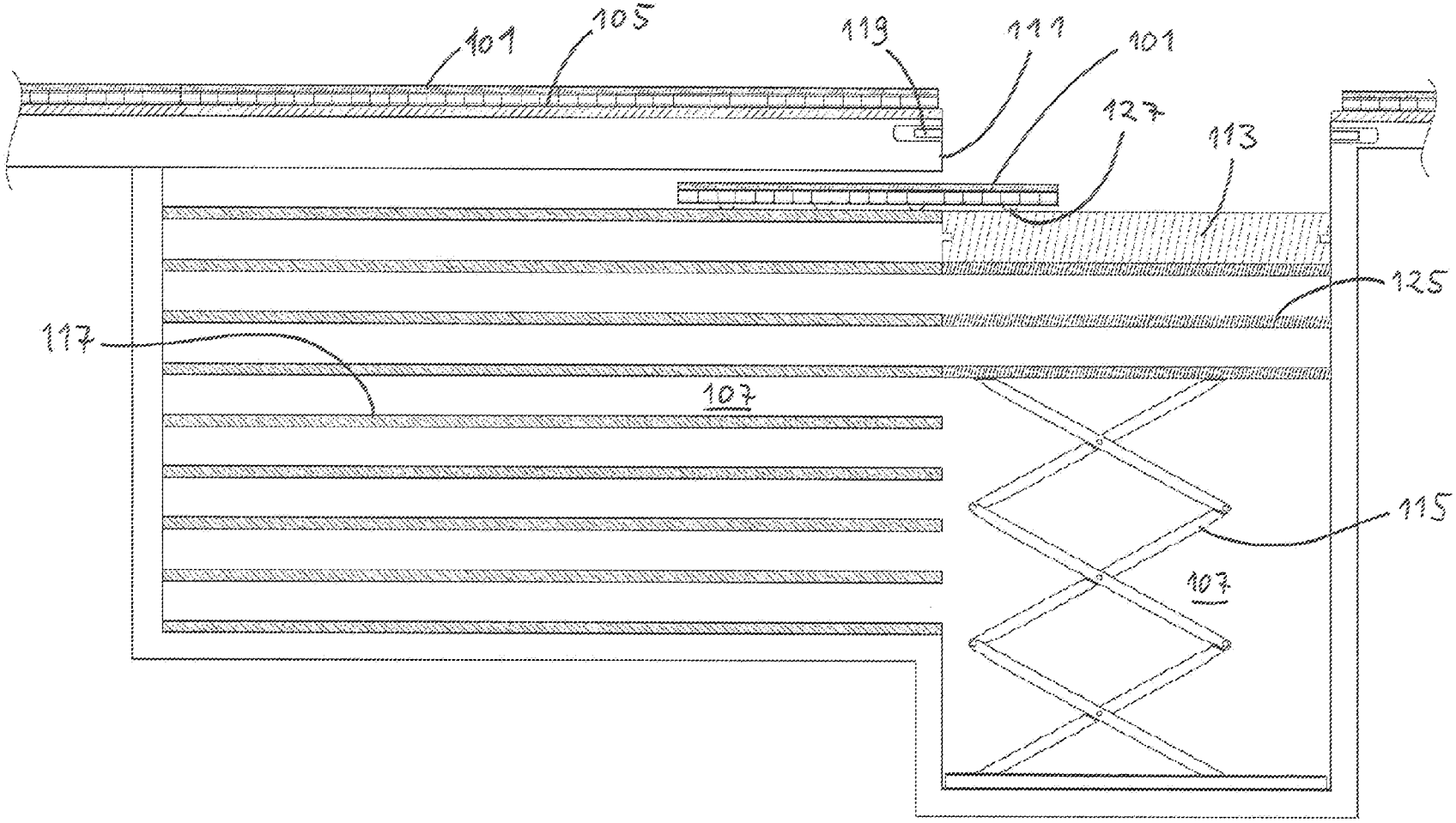
FIG. 7 is a cross section view according to FIG. 4, showing a turf module being moved into a storing position in the storage room.

FIG. 6 and FIG. 7 show the cross section side view corresponding to FIG. 4, however with a turf module 101 in a transport mode. In this mode, a set of wheels 127 have been forced down with respect to the rest of the turf module 101, thereby making it possible to move the turf module 101 on the wheels 127. In FIG. 7 the turf module 101 is in the process of leaving the surface of the aperture support base 113 and enter a storage module shelf 117.

In FIG. 6 it is shown that one turf module 101 (the module at the right hand side in FIG. 6) adjacent the aperture 111 is moved slightly away from the aperture 111, in order to move the turf module 101 on the lift 115 somewhat away from its engagement with both adjacent turf modules 101.

Figure 8:
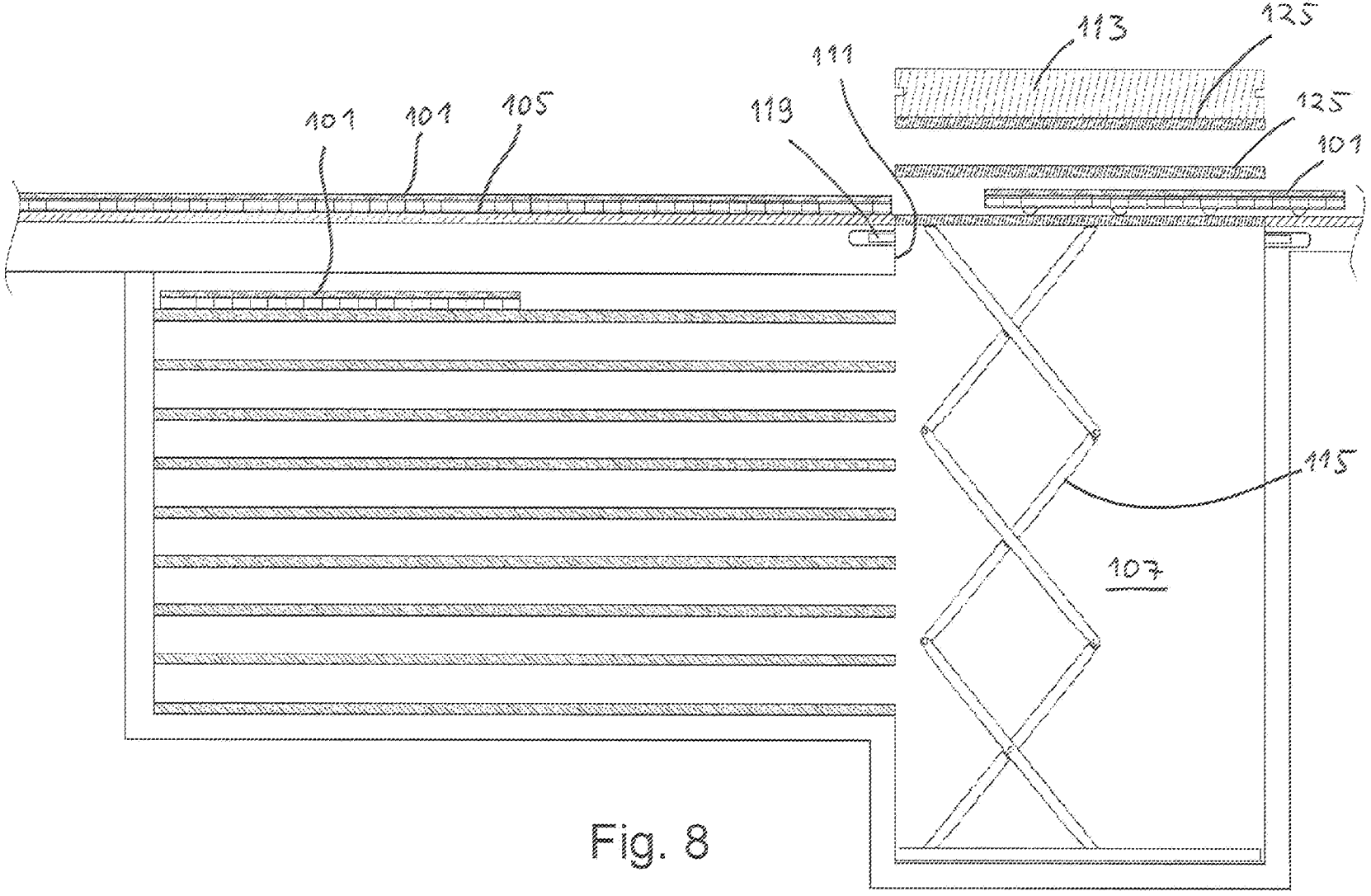
FIG. 8 is a cross section view according to FIG. 4, showing the lift in the highest position and in the process of collecting more turf modules for transportation to the storage room.

In FIG. 8 it is shown an upper-most elevation of the lift 115. In this position a turf module 101 is moved from the fixed support base 105 onto the lowermost of the module shelves 125 of the lifting section 123 of the lift 115.

Figure 9:
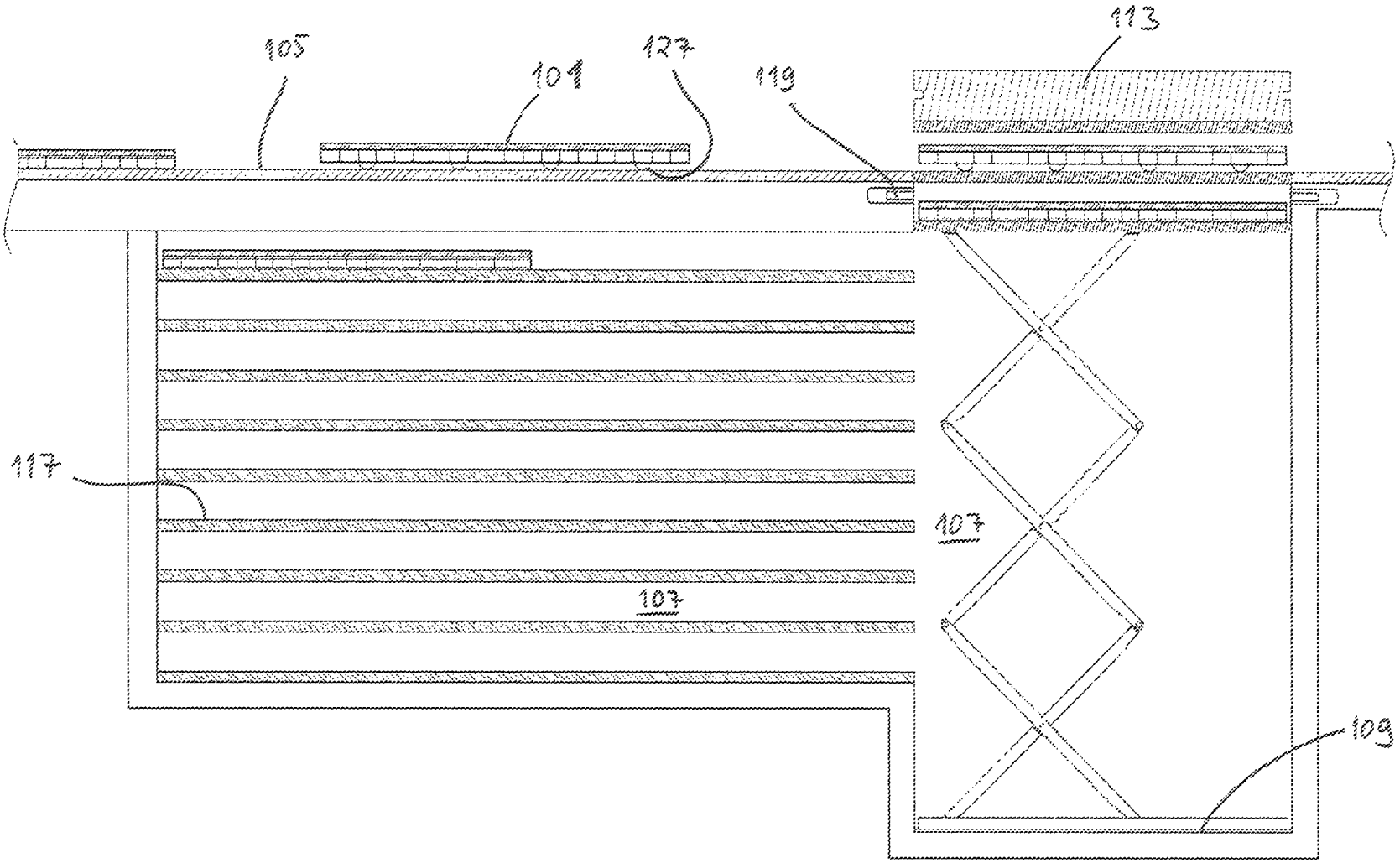
FIG. 9 is a cross section view according to FIG. 4, showing the lift collecting a second turf module.

FIG. 9 shows a slightly lower position of the lift 115. As indicated, once a turf module 101 has been moved onto a module shelf 125 the wheels 127 are pulled back up in order to avoid movement of the turf module 101 during the vertical transport of the turf module 101.

Figure 10:
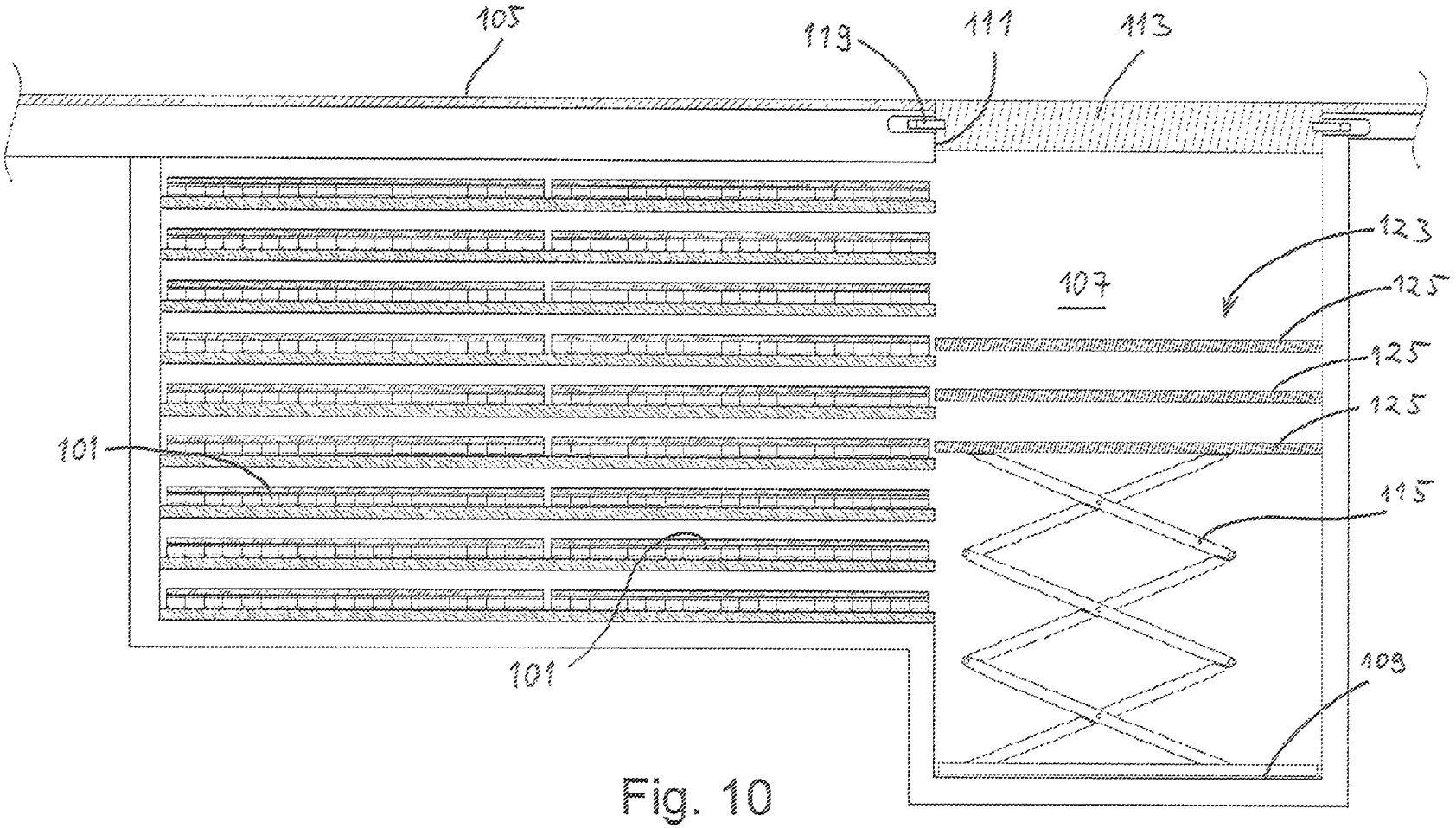
FIG. 10 is a cross section view according to FIG. 4, showing all the turf modules parked in the storage room and a removable aperture support base fixed to and in level with a fixed support base.

FIG. 10 shows a situation where all the turf modules 101 are arranged in the storage room 107 and the lift 115 is in an intermediate vertical position. The aperture support base 113 is locked in the aperture 111.

Figure 11:
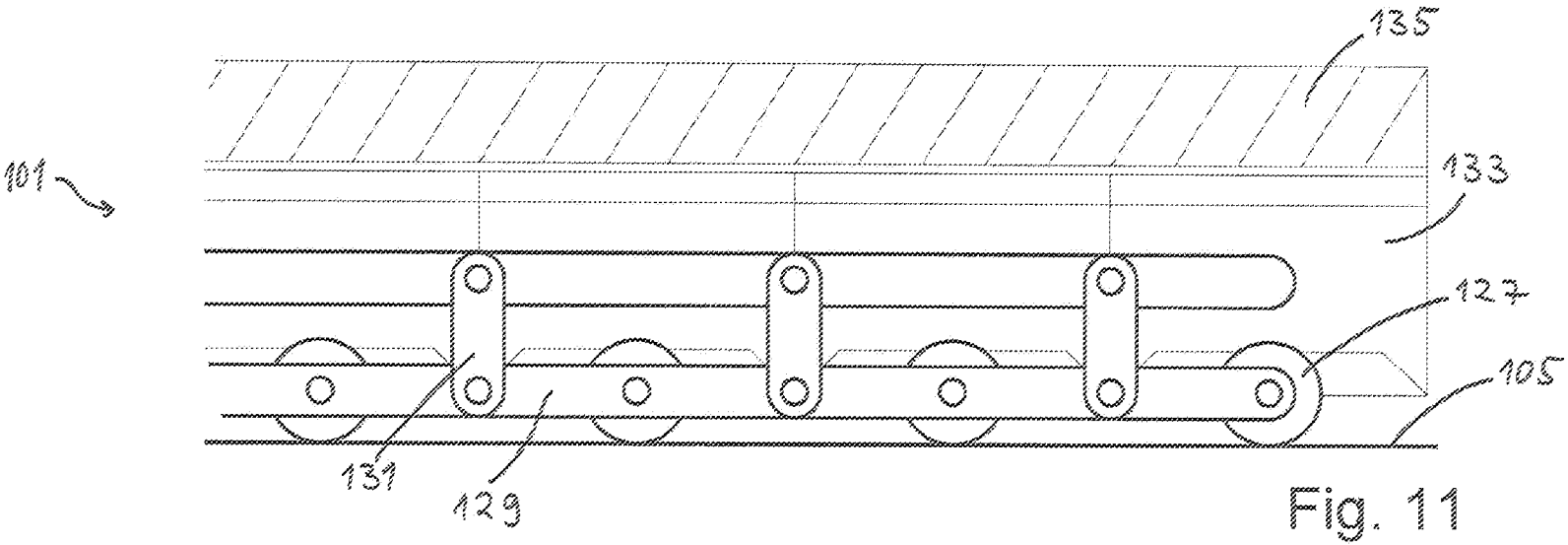
FIG. 11 is a principle side view of a part of a turf module having a set of wheels in a lower transport position.
Figure 12:
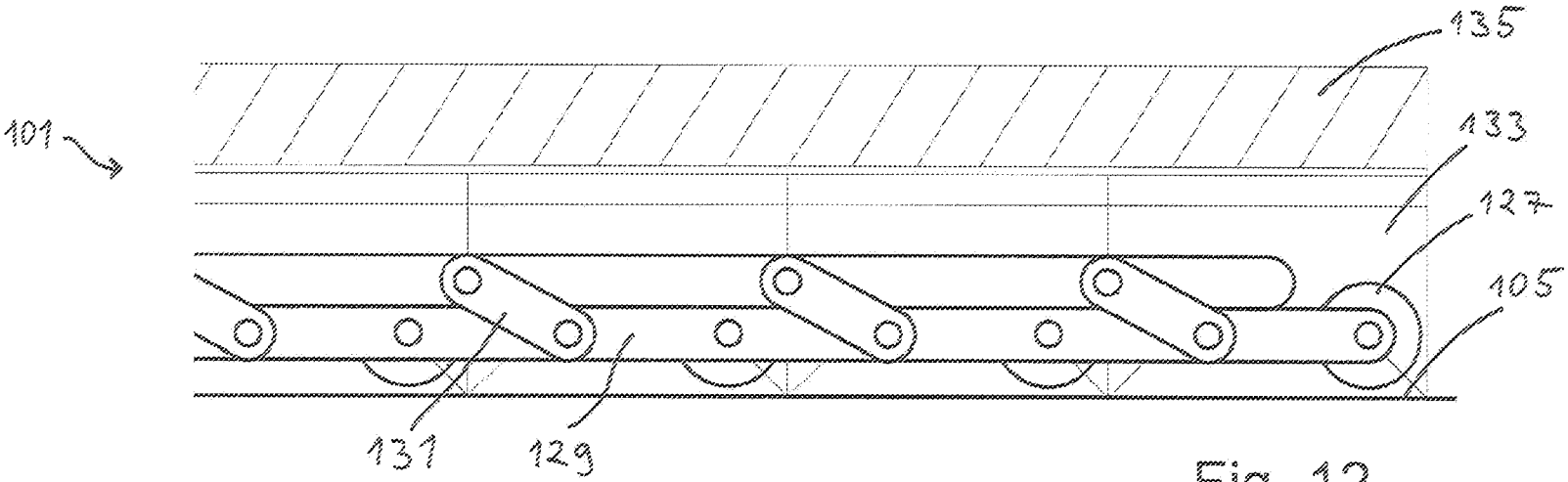
FIG. 12 is a view corresponding to FIG. 11, wherein the set of wheels is in an upper non-transport position.

FIG. 11 and FIG. 12 illustrate one embodiment of a turf module 101 having a set of wheels 127 that can be forced down for movement of the turf module 101 and be pulled up leaving the turf module 101 resting on its support. To move the set of wheels 127 between these two positions, hydraulic pistons (not shown) may be functionally arranged to a common wheel-carrying beam 129. The beam 129 can be suspended on a set of hinged support arms 131.

FIG. 11 and FIG. 12 also illustrate how the turf module 101 comprise a rigid support part 133 onto which a turf part 135 rests.

A variety of possible ways exist for moving the turf modules 101. For instance one may attach a motorized vehicle to them in order to push or pull them. One may also connect a winch to them, over a wire in order to pull them, preferably with a motorized winch.

In the storage room 107, movement of the turf modules 101 may also be performed by means of winch arrangements (not shown). One can also imagine using hydraulic pistons, for instance telescopic pistons, having one end that can attach to the modules to either push or pull the turf modules into and out of the module storage shelves 117. Another alternative is to arrange motorized conveyor belts (not shown) on the module storage shelves 117 and on the module shelf 125 of the lifting section 123 of the lift 115.

Figure 13:
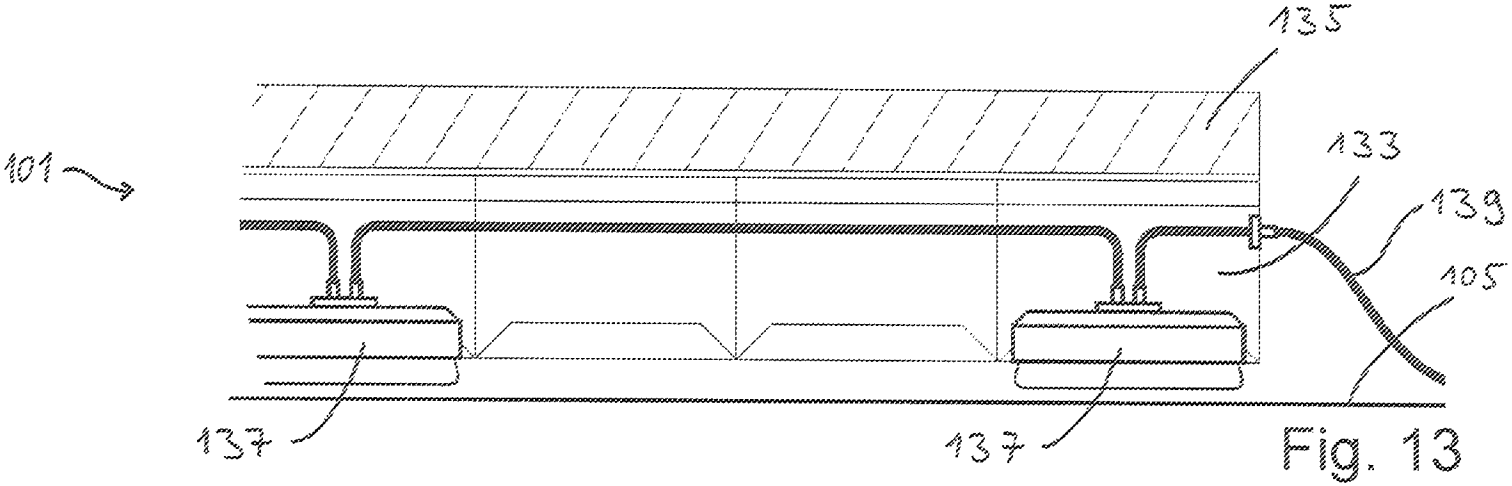
FIG. 13 is a principle side view of a part of a turf module having a set of air cushions arranged to facilitate movement of the turf module.
Figure 14:
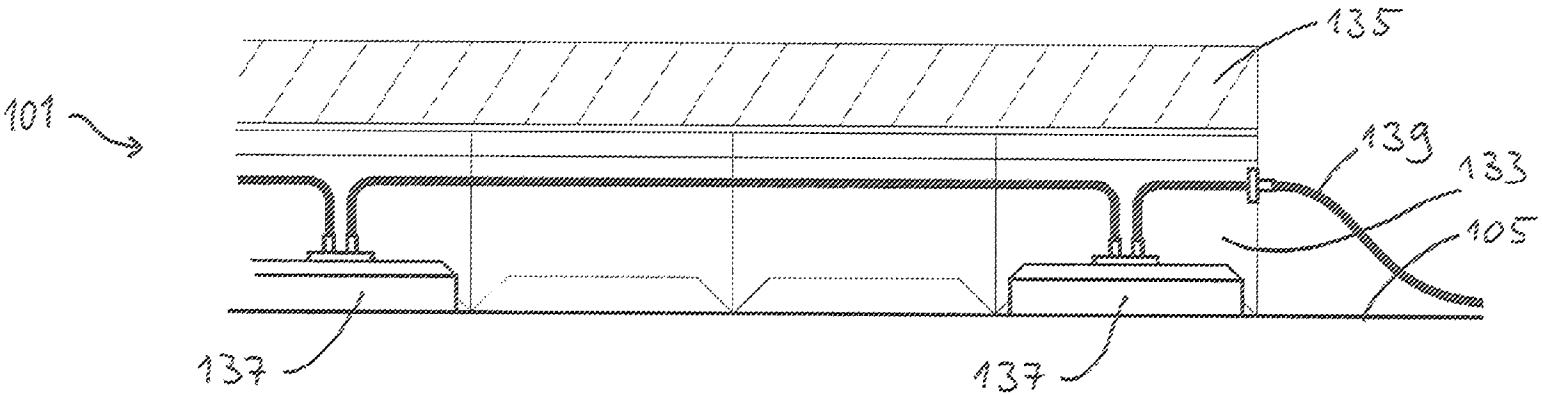
FIG. 14 is a view corresponding to FIG. 13, wherein the air cushions are not in use.

FIG. 13 and FIG. 14 show an alternative embodiment of the turf modules 101. Here, in stead of the set of wheels 127 described above, the turf modules 101 are provided with a set of air cushion elements 137. Pressurized air is delivered to the air cushion elements 137 through a flexible air hose 139. Thus, the user can elevate the turf module 101 a small extent by applying pressurized air, thereby making it possible to move the turf module 101 in an arbitrary horizontal direction.

Figure 15:
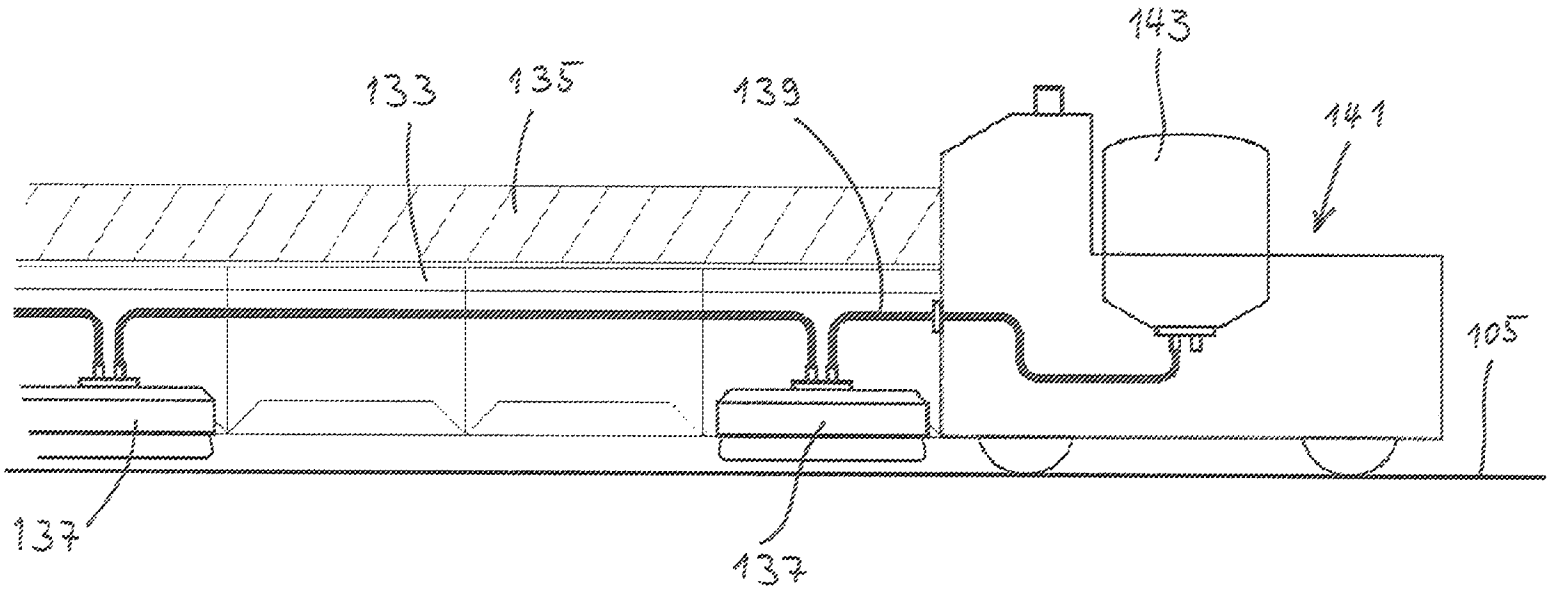
FIG. 15 is a principle view of a turf module and a module truck arranged to move the turf module.

FIG. 15 shows a turf module 101 and a motorized module truck 141 arranged to move the turf module. The module truck 141 has a pressurized air delivery system 143. When the module truck 141 has mechanically connected to the turf module 101 it supplies pressurized air to the air cushion elements 137 to make the turf module 101 movable on the fixed support base 105. In this manner the turf module 101 can be transported to the desired location, either to its functional location on the fixed support base 105, or to the lift 115 (aperture 111), in order to store it in the storage room 107.

Such a module truck 141 could also be employed with a turf module 101 having a set of wheels 127, as described above. The truck 141 could then for instance deliver hydraulic pressure to the turf module 101 for moving the wheels 127 up or down. The module truck 141 could also, in stead, have a mechanical interface with the turf module 101 enabling actuation of the wheels 127 up or down. This could for instance be a mechanical rotating interface.

Figure 16:
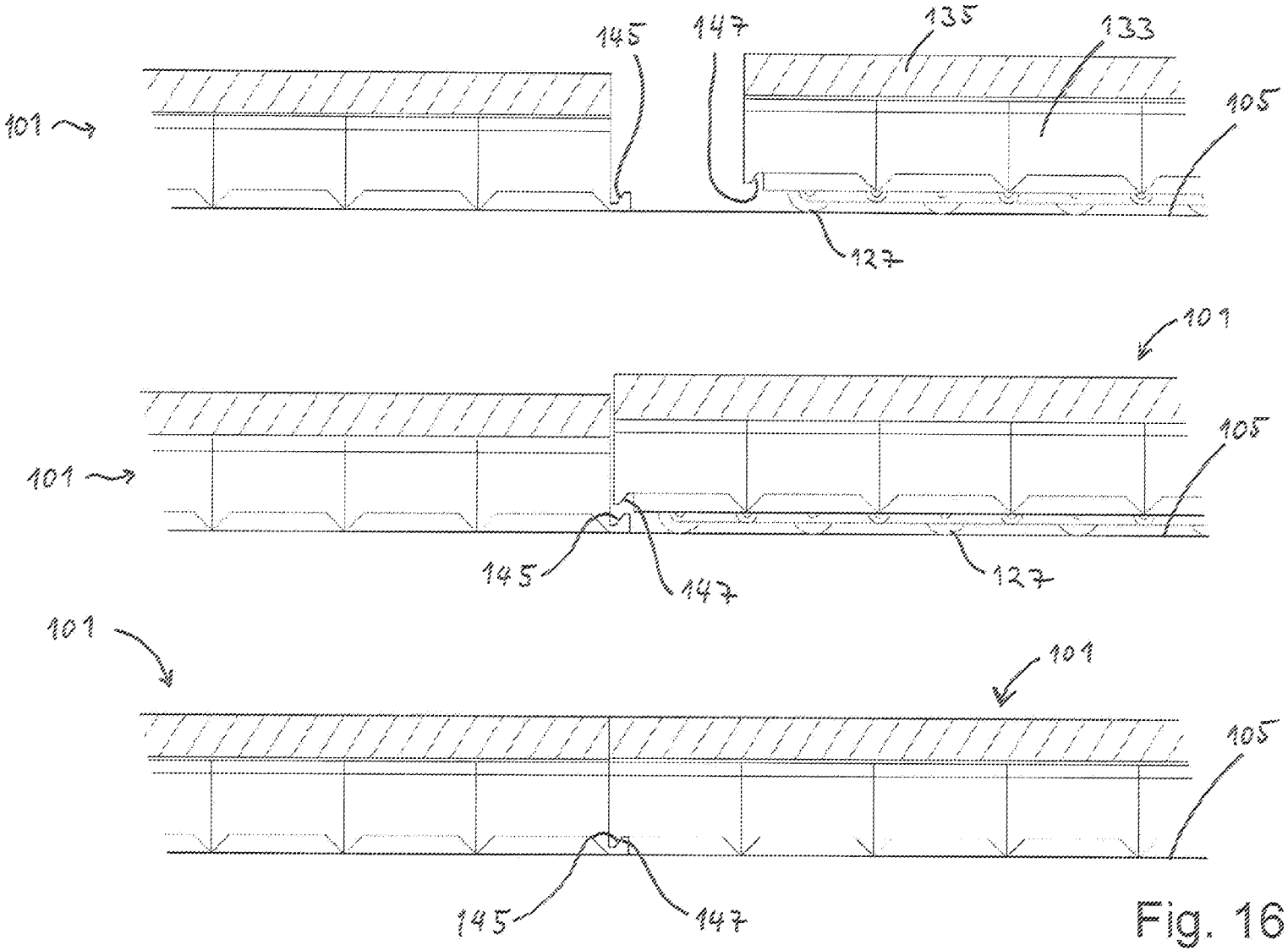
FIG. 16 shows three stages of interconnecting two turf modules and an interlocking mechanism.

FIG. 16 shows three stages of interlocking adjacent turf modules 101 by means of an interlocking mechanism 145, 147. The upper view of FIG. 16 shows the turf module 101 on the right being moved on the wheels 127 towards an already positioned left turf module 101. When arranged in abutment with the left module, the wheels 127 are pulled up, thereby moving the turf module 101 down. The interlocking mechanism exhibits an engaging member on one turf module 101 having an inclined engagement face 145 and a receiving inclined face 147 in the adjacent turf module 101. With the wheels 127 pulled up, the two engaging inclined faces 145, 147 will ensure that the two adjacent turf modules 101 remain in close contact with each other. That is, one of the turf modules 101 (the one on the right hand side of FIG. 16) needs to be elevated in order to move them apart. Such elevation is for instance accomplished by forcing down the wheels 127 or by activation of the air cushions 137 described above.

The invention claimed is:

1. A sports stadium with a turf field and a surrounding spectators stand, wherein the turf field comprises:

a plurality of turf modules supported on a fixed support base, the plurality of turf modules are movable on the fixed support base, thereby being removable from the fixed support base;

wherein the fixed support base comprises an aperture providing access to a storage room underneath the fixed support base, the storage room being adapted for storage of the turf modules;

wherein a lift is arranged to move the turf modules through the aperture; and wherein the turf modules comprise at least one of natural or artificial turf.

2. The sports stadium according to claim 1, wherein the sports stadium comprises an aperture support base adapted to be removably fixed in the aperture.

3. The sports stadium according to claim 1, wherein the lift comprises a lifting section having two or more module shelves each adapted to accommodate one of the turf modules.

4. The sports stadium according to claim 1, wherein the turf modules comprise an interlocking mechanism that releasably locks the turf modules together.

5. The sports stadium according to claim 1, wherein the turf modules comprise a largest turf module comprising an area of more than 30 $m^2$.

6. The sports stadium according to claim 1, wherein the turf field comprises less than 100 of the turf modules.

7. The sports stadium according to claim 1, wherein the lift is arranged below the aperture and a plurality of module storage shelves in the storage room are arranged in a vertical row adjacent a vertical lifting path of the lift.

8. The sports stadium according to claim 1, wherein the aperture is arranged at a distance from the surrounding spectators stand of at least a distance equal to a width of one of the turf modules.

9. The sports stadium according to claim 1, wherein the turf modules comprise a set of wheels that are adapted to be moved up and down with respect to the turf module, thereby enabling movement of the turf modules on the fixed support base.

10. The sports stadium according to claim 1, wherein the storage room comprises artificial lighting adapted for grass growth.

11. A method of removing a turf field of a sports stadium, said turf field being surrounded by spectator stands, wherein the turf field comprises a plurality of turf modules assembled together to constitute the turf field, the method comprising:

a) moving the turf modules with a lift, from a position on a fixed support base through an aperture in the fixed support base, the support base being arranged underneath the turf field, and into a storage room underneath said fixed support base; and b) arranging an aperture support base in the aperture.

12. A method of protecting a turf field of a sports stadium from a cold temperature during winter, the method comprising:

a) moving a plurality of turf modules through an aperture in a fixed support base, arranged below the plurality of turf modules, and into a storage room underneath said fixed support base;

b) maintaining a storage room temperature in the storage room that is warmer than the cold temperature; and c) lighting and watering the turf modules.

13. A sports stadium with a turf field and a surrounding spectators stand, wherein the turf field comprises:

a plurality of turf modules supported on a fixed support base, the plurality of turf modules are movable on the fixed support base, thereby being removable from the fixed support base;

wherein the fixed support base comprises an aperture providing access to a storage room underneath the fixed support base, the storage room being adapted for storage of the turf modules;

wherein a lift is arranged to move the turf modules through the aperture;

wherein the sports stadium comprises an aperture support base adapted to be removably fixed in the aperture; and wherein the turf modules comprise at least one of natural or artificial turf.

* * * * *